United States Patent [19]

Tuovinen et al.

[11] 4,424,959

[45] Jan. 10, 1984

[54] BRICKWORK CONSTRUCTION

[75] Inventors: Frans H. Tuovinen, Ulvila; Pentti O. Hokkanen, Tornio; Aimo A. Nurminen, Tornio; Lauri A. Mustikka, Tornio; Matti A. Virta, Tornio, all of Finland

[73] Assignee: Outokumpu Oy, Helsinki, Finland

[21] Appl. No.: 344,594

[22] Filed: Jun. 18, 1982

Related U.S. Application Data

[63] Continuation-in-part of Ser. No. 314,769, Oct. 26, 1981, abandoned.

[30] Foreign Application Priority Data

Oct. 27, 1980 [FI] Finland ..... 803353

[51] Int. Cl.[3] ..... F27B 1/14

[52] U.S. Cl. ..... 266/283; 266/265; 266/285; 266/280

[58] Field of Search ..... 266/280, 283, 285, 286, 266/287; 373/164; 52/245, 246, 249

[56] References Cited

U.S. PATENT DOCUMENTS

| | | | |
|---|---|---|---|
| 1,833,712 | 11/1931 | Hawke | 266/286 |
| 3,636,872 | 1/1972 | Forcier | 110/182.5 |
| 3,830,481 | 8/1974 | Dominguez | 266/283 |

*Primary Examiner*—L. Dewayne Rutledge
*Assistant Examiner*—Christopher W. Brody
*Attorney, Agent, or Firm*—Brooks, Haidt, Haffner & Delahunty

[57] ABSTRACT

A brickwork construction is disclosed as specifically useful for making the gas distribution chamber of a shaft kiln. In this construction the collapse of the wall into the shaft kiln is prevented by using bricks which are thinner at one end than the other and are laid to make a wall in which there is a straight inner surface to the shaft kiln and an arched side to the gas distribution chamber.

4 Claims, 3 Drawing Figures

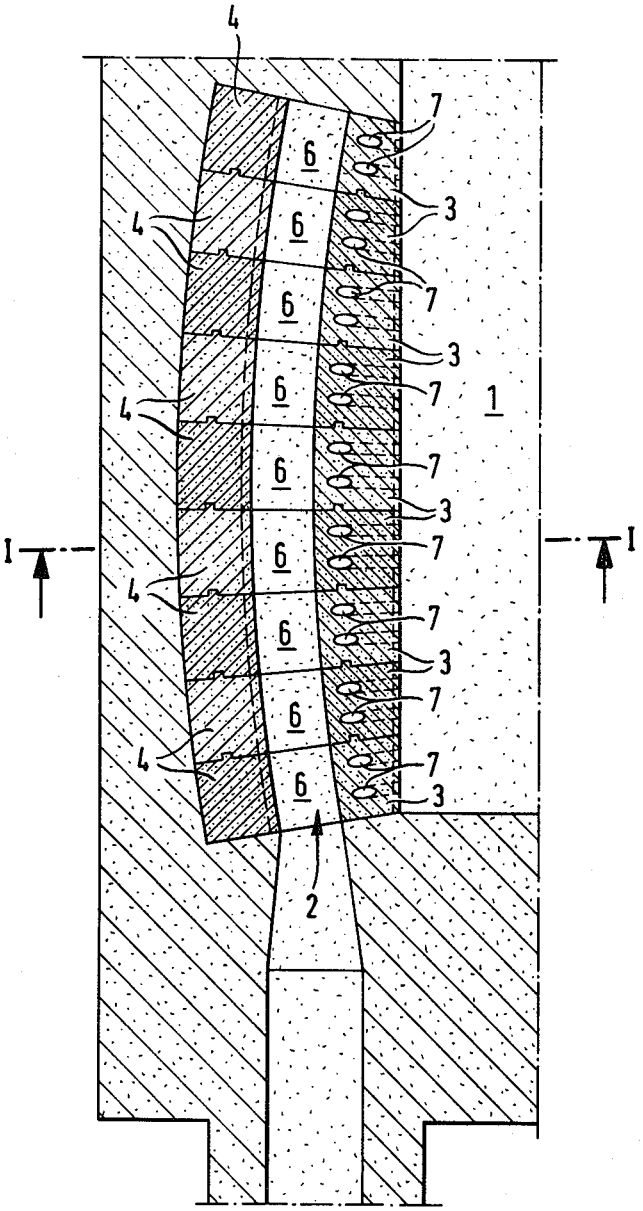
Fig. 2 (A-A)

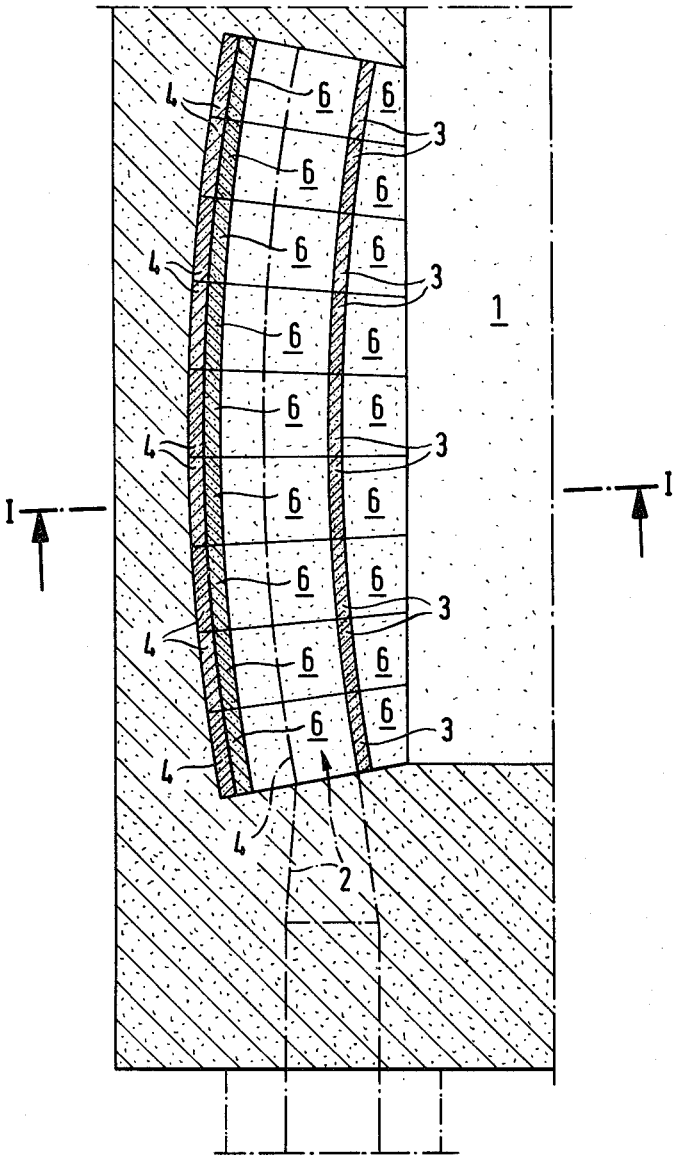
Fig. 3 (B-B)

BRICKWORK CONSTRUCTION

CROSS REFERENCE TO RELATED APPLICATION

This application is a continuation-in-part of application Ser. No. 314,769 filed Oct. 26, 1981 and having the same title, now abandoned.

BACKGROUND OF THE INVENTION

The present invention relates to a brickwork construction which is used when bricking the distribution chamber of a gas-fired kiln, for example a shaft kiln used for pellet sintering.

Normally the distribution chamber for the combustible gases is bricklined, in which case the walls adjacent to the shaft wall are parallel. The expansion and contraction caused by temperature changes is usually allowed for by leaving an expansion joint in the brickwork. These joints function well in the beginning, but in the course of time their operation deteriorates because the gaps become filled with brick dust and process dust. It is self-evident that the joints no longer serve their purpose when filled up. Subsequently, when powerful thermal stresses are imposed on the distribution chamber the consequence is usually smaller or larger cracks in the wall. When the walls are further subjected to stresses from thermal changes the consequence is collapse of the wall at the easiest path, and this usually means into the shaft kiln. As a result of this there is naturally a long interruption in the operation of the kiln.

Some attempts have been made to avoid the aforementioned troubles but the problem of collapse has not been solved. Many of these attempts have also led to process technical problems, for example, caused by changing the shape of the shaft.

The object of the invention is to avoid the drawbacks of the previous brickwork construction and to accomplish a construction in which the stresses caused in the brickwork by temperature changes will press it as a combined mass toward the kiln casing, so preventing the brickwork collapsing into the kiln.

SUMMARY OF THE INVENTION

In the construction according to the invention wedge-shaped bricks surround the combustion chamber, the bricks being laid so that their narrow ends are toward the shaft kiln, the bricks forming an arched construction.

DESCRIPTION OF THE DRAWINGS

FIG. 2 shows the section A—A of the former, and

FIG. 3 shows a section B—B of the same.

DESCRIPTION OF THE PREFERRED EMBODIMENTS

Figure 1:
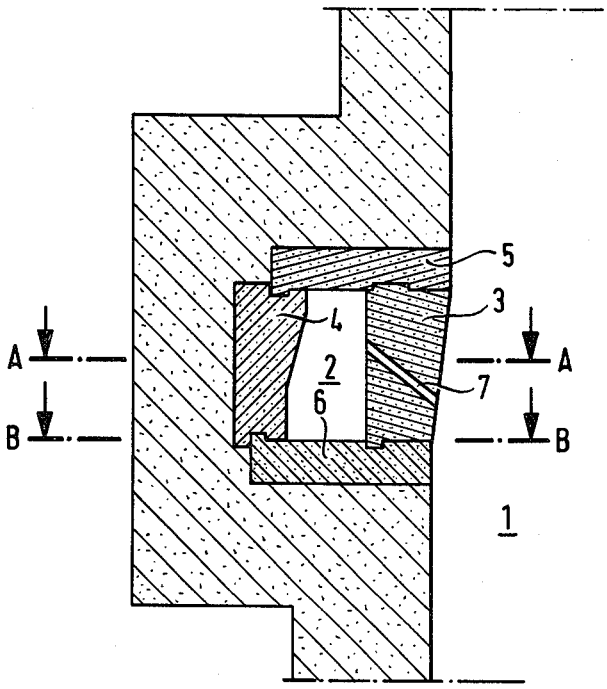
FIG. 1 shows a vertical section of the brickwork construction of the invention.

In the drawing the shaft kiln itself is marked with reference number 1, the combustion gas distribution chamber shown at reference number 2. As can be seen from the cross-section A—A, the distribution chamber for the combustion gases is made up in this case of an arrangement of four bricks 3–6, which are suitably keyed together for the closest fitting. It is naturally possible that the distribution chamber can be surrounded by more than four bricks. The distribution chamber can also be surrounded by less than four bricks, although the formation of the bricks in that case may be difficult. The bricks 3–6 around the distribution chamber are wedge-shaped, that is they are narrower at one end than the other. It is most important that these wedge-shaped bricks are set so that the narrow end of the brick is laid on the shaft kiln side. It is advantageous that the narrow end forms the straight wall of the shaft kiln. When the bricks are laid in this way they form an arch construction and it is this which prevents the risk of collapse of the wall on the shaft kiln side. It is furthermore advantageous that the bricks which are situated immediately above and below the block formed by bricks 3–6, in one or in several layers, are also wedge-shaped.

It is a characteristic feature of the brickwork construction of this invention that the walls of the square shaft kiln 1 are straight, although the brickwork construction itself is cambered, that is to say convexly curved. With this approach the cambering is transferred to the inner brickwork by using wedge-shaped bricks.

If the cambering was made so that the shaft kiln internal walls were curved the kiln would not be technically suitable for the process, because then the penetration of the gas entering through the blow-holes 7 to the bed of material in the central part of the kiln would considerably impaired.

In the construction according to the present invention the bricks surrounding the distribution chamber are already well keyed together, but the surrounding brickwork also presses them into a compact block around the distribution chamber. Furthermore in this invention the expansion joints in the construction function fundamentally in the opposite way to those in contemporary brickwork constructions. In other words the filling up of the joints and stiffening of the structure directs the stresses caused by thermal expansion still more towards the kiln casing. The construction suggested in this invention also prevents one of the drawbacks of current constructions, in that the blow-holes for the combustion gases can be set equidistant from one another through the shaft cross-section. Previous attempts to improve constructions have in particular led to irregular spacing of the blow-holes. The blow-holes are seen at reference 7. The invention here described is also suitable for use in those cases where blow-holes are located between bricks, in their joints, and not in the bricks themselves.

The construction of the present invention can be used in other applications than the case of the shaft kiln which is used here as an example. It is fundamental that it is desired to direct compression loading into a known direction as a result of using the wedging principle, and thus ensure that the construction does not collapse into the shaft.

We claim:

1. A brickwork construction for use when making a gas distribution chamber for a shaft kiln of the type having internal wall surfaces which are essentially straight in both the horizontal and vertical directions comprising: wedge-shaped bricks surrounding the combustion gas distribution chamber, the bricks being laid so that narrow ends of the bricks are towards the shaft kiln forming a generally planar internal wall of the shaft kiln, the bricks forming an arched construction.

2. The brickwork construction of claim 1 in which bricks which are situated immediately above and below the bricks surrounding the gas distribution chamber are also wedge shaped.

3. The brickwork construction of claim 1, in which the bricks are keyed and locked together.

4. The brickwork construction of claim 1, comprising bricks having gas blow-apertures on the side facing the shaft.

* * * * *